US006438914B1

(12) United States Patent
Robertson

(10) Patent No.: US 6,438,914 B1
(45) Date of Patent: Aug. 27, 2002

(54) DRYWALL TRIM PIECE

(76) Inventor: Frederick J. Robertson, 17002 SE. 16th St., Vancouver, WA (US) 98683

( * ) Notice: Subject to any disclaimer, the term of this patent is extended or adjusted under 35 U.S.C. 154(b) by 0 days.

(21) Appl. No.: 09/690,691

(22) Filed: Oct. 16, 2000

Related U.S. Application Data

(63) Continuation-in-part of application No. 09/571,945, filed on May 15, 2000.

(51) Int. Cl.[7] ..... E04G 11/00

(52) U.S. Cl. ..... 52/255; 52/287.1; 52/257; 52/256; 52/288.1

(58) Field of Search ..... 52/287.1, 716.1, 52/717.05, 717.03, 254, 255, 256, 257, 288.1

(56) References Cited

U.S. PATENT DOCUMENTS

D351,988 S * 11/1994 Gotcher ..... D8/403
5,778,617 A * 7/1998 Free ..... 52/255
5,904,016 A * 5/1999 Koenig et al. ..... 52/255

* cited by examiner

*Primary Examiner*—Robert Canfield
*Assistant Examiner*—Patrick J. Chavez
(74) *Attorney, Agent, or Firm*—John Smith-Hill; Smith-Hill and Bedell

(57) ABSTRACT

A trim piece for installing at a drywall external right angle corner which is provided with a bullnose corner bead includes an intermediate portion which wraps over the convexly curved portion of the bullnose corner bead and has two edges extending parallel to the edges of the flanges of the corner bead. Two leaves are attached to the intermediate portion of the trim piece at the two edges respectively. The intermediate portion of the trim piece has an interior surface at a first end matching closely the exterior surface of the corner bead and an exterior surface which is convexly curved at the first end and is right-angled at the opposite second end and provides a transition from the convex curve to the right angle between the first and second ends.

15 Claims, 6 Drawing Sheets

DRYWALL TRIM PIECE

CROSS-REFERENCE TO RELATED APPLICATION

This application is a continuation-in-part of copending U.S. patent application Ser. No. 09/571,945 filed May 15, 2000, the entire disclosure of which is incorporated by reference herein.

BACKGROUND OF THE INVENTION

This invention relates to a drywall trim piece for installing at an external right angle corner at which two drywall boards meet and which is provided with a bullnose corner bead.

In standard wall board construction practice, an external corner joint, formed where wall board of a first wall surface meets wall board of a second wall surface, may be covered with a protective corner bead. The corner bead is typically made of steel, formed as a single strip held in place against the wall boards of the two wall surfaces by nails or by a thin layer of joint compound between the flanges of the corner bead and the wall surfaces. When the corner bead has been secured in position, joint compound is applied over the flanges of the corner bead and the adjacent wall surfaces to provide a smooth finish.

After the drywall has been installed and finished, baseboard is typically installed along the base of each wall. At external corners, the two strips of baseboard material that meet at the corner are typically mitered to provide a uniform external surface profile up to the point at which the strips meet.

The conventional method of installing corner bead and baseboard is advantageous because it allows fairly wide tolerance on positioning the lower end of the corner bead. As long as the lower end of the corner bead is below the upper edge of the base board, there is no unsightly gap or rough edge. Since the base board is typically at least three inches wide, it is not necessary to cut the corner bead very accurately.

This technique for installation of drywall and baseboard has worked well when the corner bead has a substantially right angle profile because the exterior configuration of the corner bead, after the joint compound has been applied, matches the interior configuration of the baseboard at the corner. Recently, however, bullnose corner bead, in which the corner bead includes, between the planar flanges, an intermediate portion having a radius of curvature as large as one inch, has come into favor. If conventional 45° miters are used in the baseboard material at an external corner provided with bullnose corner bead, there can be an unsightly gap between the exterior of the bullnose corner bead and the strips of baseboard material.

Several techniques have been developed for avoiding the problem created by the difference between the external configuration of the drywall corner and the internal configuration of the baseboard. One technique involves use of a trim piece which provides a transition between the curved exterior surface of the bullnose corner bead and the right angle internal corner of the baseboard. This trim piece is made of a hard synthetic polymer material. At its upper end, the trim piece has a tongue which is shaped and sized to fit under the bullnose corner bead. Just below the tongue, the exterior surface of the trim piece substantially matches the exterior surface of the corner bead. There is then a transition area, about ½ inch high, over which the configuration of the exterior surface changes from one that matches the exterior surface of the corner bead to a right angle, which matches the internal configuration of the baseboard corner. The corner bead is installed at the corner so that its lower end is slightly above the upper edge of the baseboard that is to be used. The trim piece is installed with its lower end resting on the floor and the tongue at its upper end is inserted under the lower end of the bullnose corner bead. The baseboard is then installed and the trim piece provides a smooth transition from the external configuration of the corner bead to the internal configuration of the baseboard corner.

In practice, the known trim piece is subject to several disadvantages. For example, the lower end of the corner bead must be accurately positioned to within about ¼ inch above the upper edge of the baseboard material. Also, the height of the lower end of the corner bead determines the height of the baseboard and it is costly and inconvenient to use baseboard material of different height. Further, the height of the trim piece depends on the height of the baseboard material and therefore an installer who is working with several different heights of baseboard material must hold several different sizes of trim pieces in inventory, increasing the cost of inventory and giving rise to the danger that the wrong size pieces will be shipped to a particular job site.

SUMMARY OF THE INVENTION

In accordance with a first aspect of the invention there is provided a trim piece for installing at a drywall external right angle corner at which two drywall boards meet and which is provided with a bullnose corner bead having first and second flanges extending over the two drywall boards respectively and a convexly curved portion joining the first and second flanges, the first and second flanges having respective mutually parallel free edges, said trim piece comprising an intermediate portion which wraps over the convexly curved portion of the bullnose corner bead and has first and second edges extending parallel to the edges of the flanges of the corner bead and also has two opposite ends, first and second leaves attached to the intermediate portion of the trim piece at the first and second edges respectively, and first and second pins projecting from the first and second leaves respectively, the first and second pins being located so that when the trim piece is placed over the corner bead and the leaves are forced against the flanges of the corner bead, the pins are driven into the drywall boards and a flank of each pin bears firmly against a free edge of a flange of the corner bead, whereby the trim piece is held in position relative to the corner bead, and the intermediate portion of the trim piece including a transition region having a first end at one end of the intermediate portion and a second end spaced from the first end, the transition region having an interior surface at said first end matching closely the exterior surface of the corner bead at said first end and an exterior surface which is convexly curved at said first end and is right-angled at said second end and provides a transition from the convex curve to the right angle between said first and second ends.

In accordance with a second aspect of the invention there is provided a trim piece for installing at a drywall external right angle corner at which two drywall boards meet and which is provided with a bullnose corner bead having first and second flanges extending over the two drywall boards respectively and a convexly curved portion joining the first and second flanges, the first and second flanges having respective mutually parallel free edges, said trim piece comprising an intermediate portion which wraps over the convexly curved portion of the bullnose corner bead and has first and second edges extending parallel to the edges of the flanges of the corner bead and also has two opposite ends, and first and second leaves attached to the intermediate portion of the trim piece at the first and second edges respectively, and the intermediate portion of the trim piece including a transition region having a first end at one end of the intermediate portion and a second end spaced from the first end, the transition region having an interior surface at said first end matching closely the exterior surface of the corner bead at said first end and an exterior surface which is convexly curved at said first end and is right-angled at said second end and provides a transition from the convex curve to the right angle between said first and second ends.

In accordance with a third aspect of the invention there is provided a trim piece for installing at an intersection of three drywall external right angle corners each provided with a corner bead having first and second flanges, the flanges of each corner bead having respective substantially mutually parallel free edges that are substantially perpendicular to the free edges of the flanges of the other corner beads, said trim piece comprising a three-sided corner portion for fitting over the intersection, and three limbs that project from the corner portion for fitting over the three corner beads respectively, and wherein each limb includes two flanges that fit against respective flanges of the corner bead over which the limb extends.

In accordance with a fourth aspect of the invention there is provided a method of finishing an intersection of three drywall external right angle corners each provided with a corner bead having first and second flanges, the flanges of each corner bead having respective substantially mutually parallel free edges that are substantially perpendicular to the free edges of the flanges of the other corner beads, said method including providing a trim piece having a three-sided corner portion and three limbs that project from the corner portion, and wherein each limb includes two flanges that fit against respective flanges of the corner bead over which the limb extends, positioning the trim piece with the corner portion over the intersection of the drywall external corners and with the limbs over the corner beads respectively, and attaching the trim piece to the underlying structure.

BRIEF DESCRIPTION OF THE DRAWINGS

For a better understanding of the invention, and to show how the same may be carried into effect, reference will now be made, by way of example, to the accompanying drawings, in which.

In the several figures of the drawings, the thicknesses of various elements are exaggerated for the sake of clarity.

DETAILED DESCRIPTION

Figure 1:
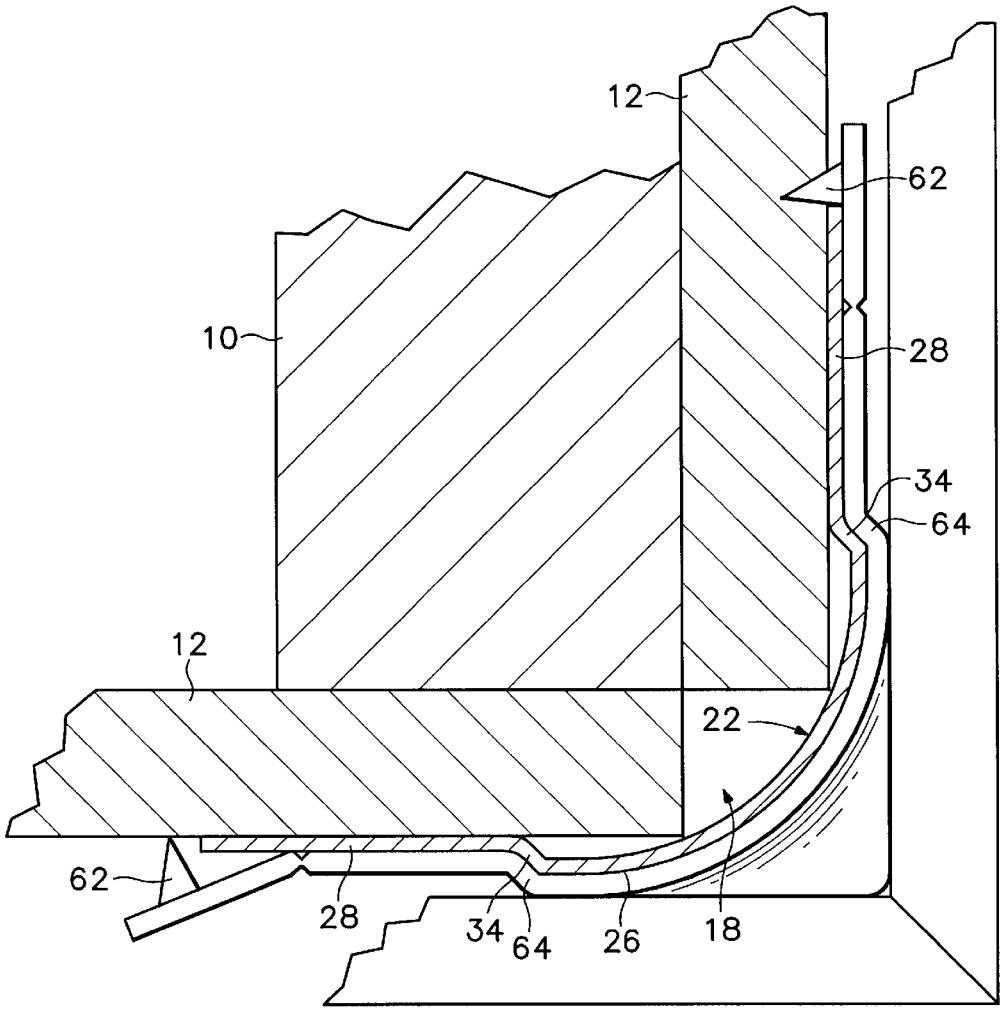
FIG. 1 is a horizontal sectional view of an external right angle corner provided with bullnose corner bead and a first trim piece in accordance with the invention.

FIG. 1 illustrates an external corner of a structure including a vertical stud 10 and drywall boards 12 attached to the stud by nails (not shown) and meeting at substantially a right angle to form an external corner 18. A strip 22 of bullnose corner bead has a curved intermediate portion 26 and two planar flanges 28 which meet the intermediate portion 26 at respective steps 34. The corner bead is positioned so that the two flanges 28 lie against the external surfaces of the drywall boards 12 respectively. The corner bead is held in position by nails (not shown) or it may alternatively be secured to the drywall boards by a thin layer of joint compound (not shown) between the flanges and the drywall boards.

Figure 2:
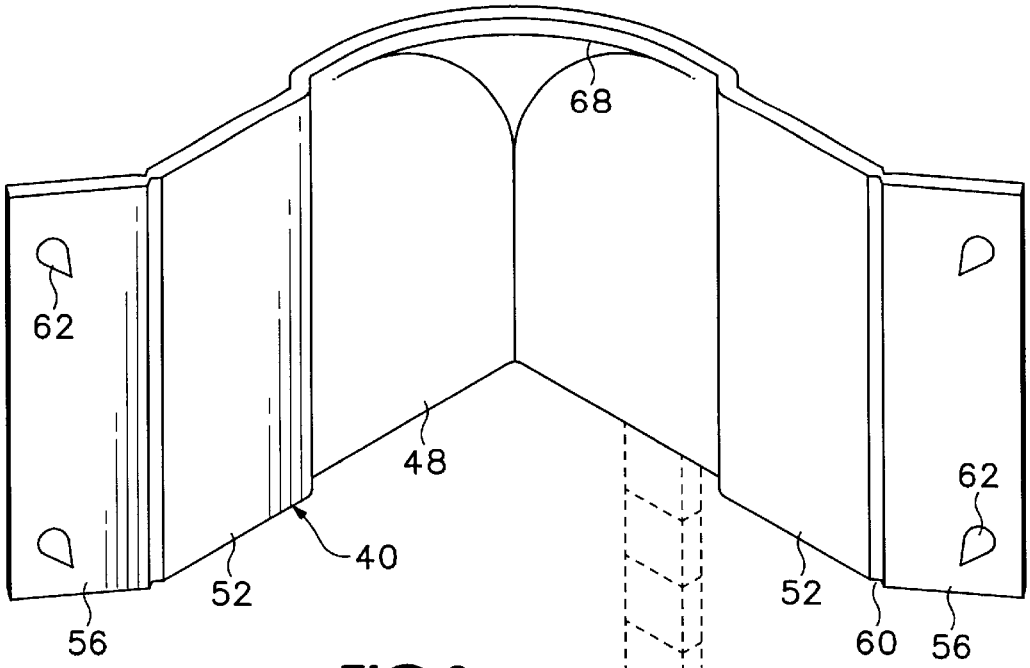
FIG. 2 is an interior perspective view of the first trim piece.
Figure 3:
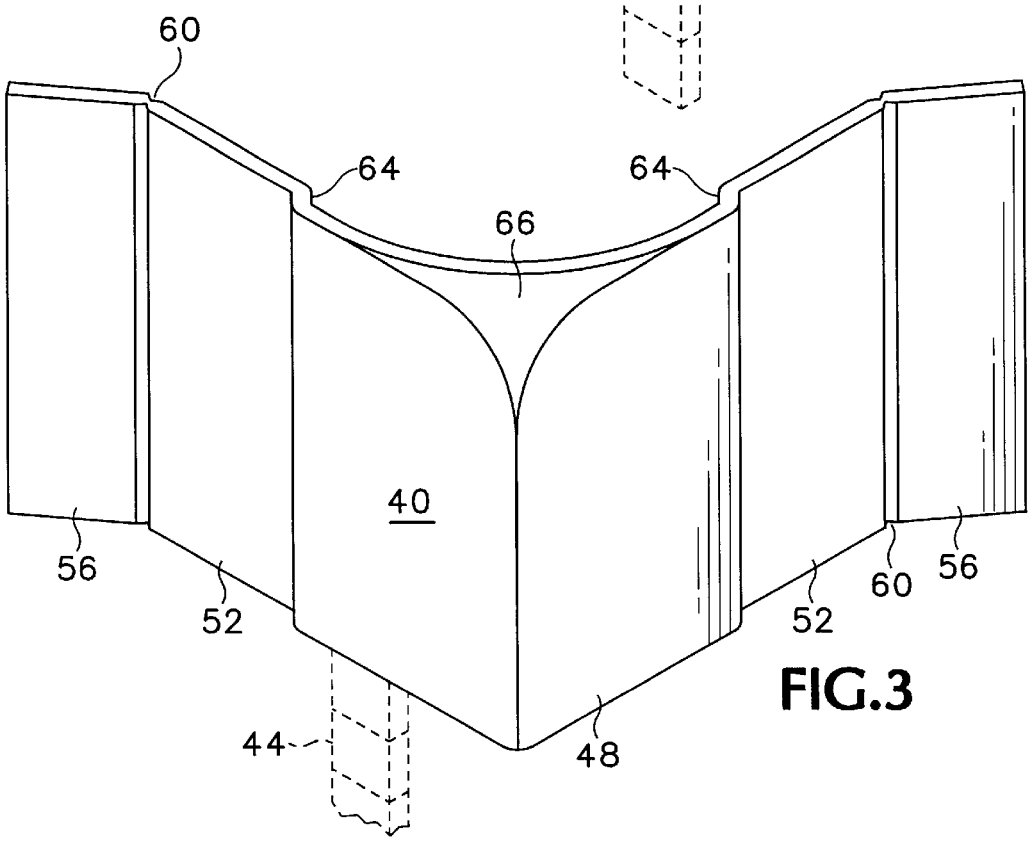
FIG. 3 is an exterior perspective view of the first trim piece.
Figure 4:
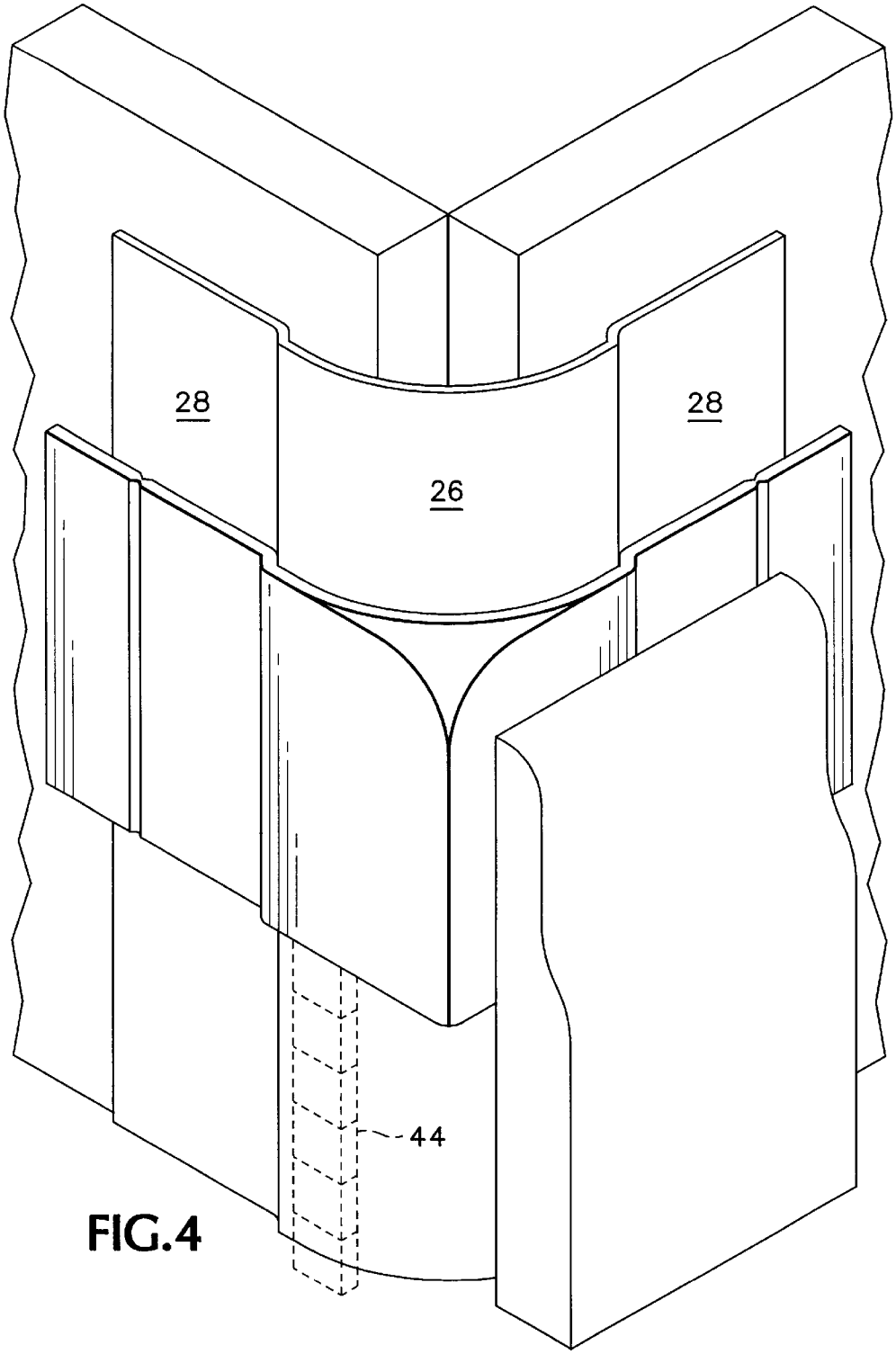
FIG. 4 is a perspective view of the first trim piece installed at an external right angle corner.

FIGS. 2 and 3 illustrate a trim piece in accordance with the invention. The trim piece is made of synthetic polymer material such as ABS, which is quite hard. The trim piece has a body 40. An optional gauge strip 44, which is shown in phantom, is attached to the body 40. The function of the gauge strip will be described below.

The body 40 of the trim piece is composed of an intermediate portion 48 and two flanges 52. Two tabs 56 are attached to the flanges 52 at respective edges thereof. The thickness of the polymer material is such that the trim piece is stiff except along the lines 60 at which the tabs are attached to the body, where the material is sufficiently thin to act as a hinge and allow pivotal movement of the tabs 56 relative to the body 40 of the trim piece.

The two tabs 56 are each provided with upper and lower pins 62. The trim piece is made by injection molding and the mold is designed so that in the unstressed condition of the trim piece, the two tabs are bent outwardly from the planar surfaces of the flanges 52, such that the tips of the pins extend only slightly, if at all, beyond the planes of the flanges 52.

The height of the body 40 is less than the minimum conventional height of standard baseboard material, which is sold in widths of from about two inches to about eight inches.

The two flanges 52 of the body 40 have flat interior surfaces which meet the interior surface of the intermediate portion at steps 64 which match the steps 34 of the corner bead. The flanges 52 are uniform in configuration over the height of the trim piece.

Over the greater part of its height, the intermediate portion 48 of the body 40 of the trim piece is uniform in cross-section, having flat external surfaces that meet substantially at a right angle.

At the upper end of the trim piece, the internal surface 68 of the intermediate portion is concavely curved to fit closely against the convexly curved external surface of the intermediate portion 26 of the corner bead and the external surface of the intermediate portion is convexly curved. Slightly below the upper edge of the trim piece, the external surface of the intermediate portion is right angled, and between the upper edge and the slightly lower right angle is a transition area 66 which provides a smooth transition of the external surface from the convexly curved configuration at the upper edge to the right angle configuration.

The trim piece is installed by positioning it so that the bottom of the transition area 66 is at the expected level of the upper edge of the baseboard and accordingly the upper end of the trim piece is slightly above the upper edge of the baseboard. The trim piece is positioned so that the intermediate portion 48 sits firmly against the corner bead. The concavely curved surface 68 at the upper end of the trim piece fits snugly against the convexly curved portion of the corner bead, the flanges 52 of the trim piece fit against the flanges 28 of the corner bead, and the steps 64 between the flanges 52 and the intermediate portion 48 of the body of the trim piece fit in the steps 34 between the flanges 28 and the intermediate portion 26 of the corner bead. In this position, the tips of the pins bear only lightly if at all against the drywall boards. By virtue of the steps 64 of the trim piece fitting in the steps 34 of the corner bead, the trim piece is reliably held in alignment with the corner bead.

While holding the trim piece in position, as described, the installer strikes the two tabs 52 with a hammer, driving the pins into the drywall. The pins are positioned so that when they are driven fully into the drywall, and the tabs are in contact with the drywall over substantially their entire area, the inner flank of each pin is in firm contact with the edge of the flange 28 of the corner bead. The positions of the pins are selected so that as the pins are driven fully into the drywall board, the steel corner bead causes slight deformation of the pins. The result of this action is that the body of the trim piece is under tension between the tabs 56 and accordingly the pins are held in the fully inserted position by frictional engagement between the flanks of the pins and the free edges of the flanges and/or by virtue of the free edges of the flanges digging into the flanks of the pins. It will be noted that the inner flanks of the pins 62 are nearly perpendicular to the inner surfaces of the tabs 56 in order to maximize frictional engagement of the flanges 28 with the pins.

When the trim piece has been installed, as described above, joint compound is applied in conventional fashion over the flanges of the corner bead and over the flanges 52 and tabs 56 of the trim piece, down at least to the top edge of the baseboard.

Finally, after the joint compound has cured, the baseboard is installed. Since the trim piece was placed so that the upper edge of the baseboard would be substantially at the bottom of the transition area, the transition area spans the gap between the external surface of the corner bead and the interior of the corner at which the baseboard strips meet.

The gauge strip 44, which extends parallel to the edges of the intermediate portion, is perforated at intervals of ½ inch so that it can readily be broken, allowing the installer to easily position the trim piece at the appropriate height for a particular standard width of baseboard material.

Figure 5:
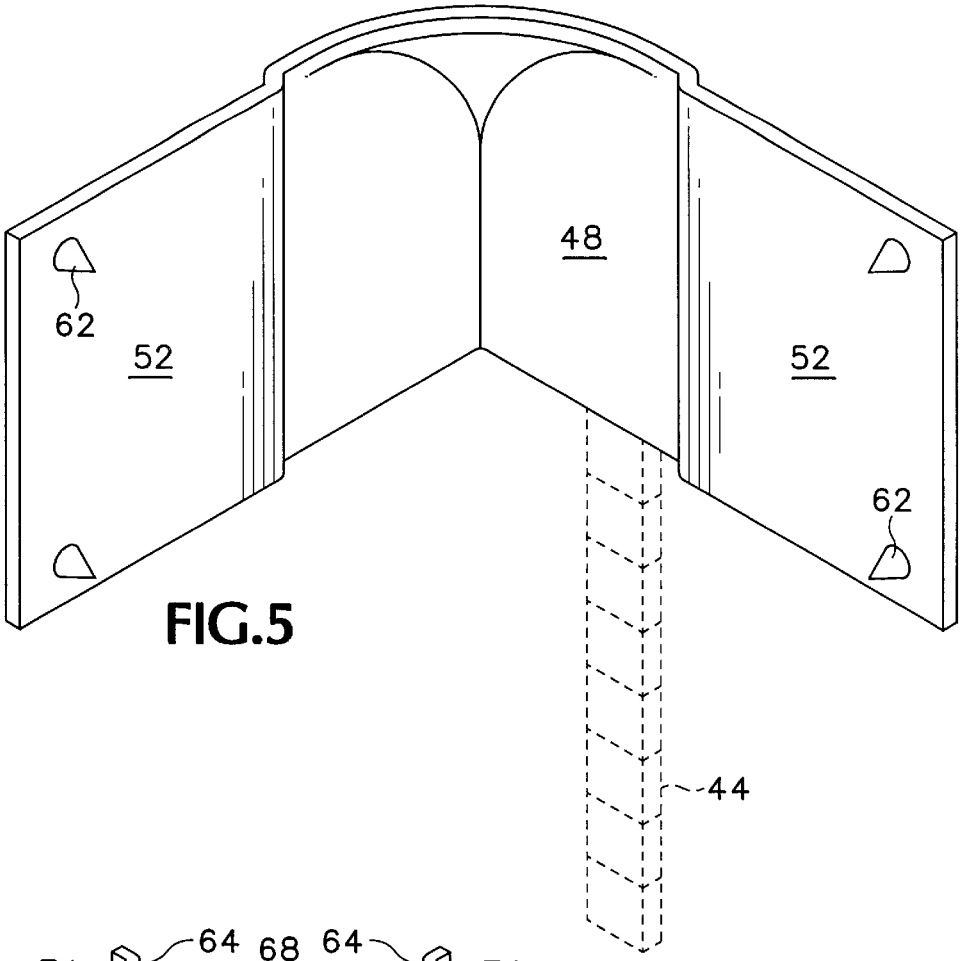
FIG. 5 is a view similar to FIG. 2 of a second trim piece in accordance with the invention, FIG. 6 a view similar to FIG. 3 of a third trim piece in accordance with the invention.

The trim piece shown in FIG. 5 is similar to that shown in FIGS. 1 and 2 except that there are no tabs 56 but the flanges 52 instead extend beyond the free edges of the flanges 28 of the corner bead and the pins 62 project from the flanges 52. In use, the installer places the trim piece so that the flanks of one pair of pins 62 rests firmly against the free edge of one of the flanges 28 of the corner bead and strikes the flange 52 lightly to drive the pins into the wall board. At this point, the flanges 52 and the intermediate portion 48 may be slightly flexed. The installer positions the other pair of pins 62 so that their tips are in contact with the wall board and strikes the flange 52 lightly with a hammer, driving the pins into the wall board. The trim piece is then seated snugly against the corner bead. As in the case of the trim piece described with reference to FIGS. 2 and 3, the pins are held in the fully inserted position by frictional engagement between the flanks of the pins and the free edges of the flanges 28 and/or by virtue of the free edges of the flanges 28 digging into the flanks of the pins.

Figure 6:
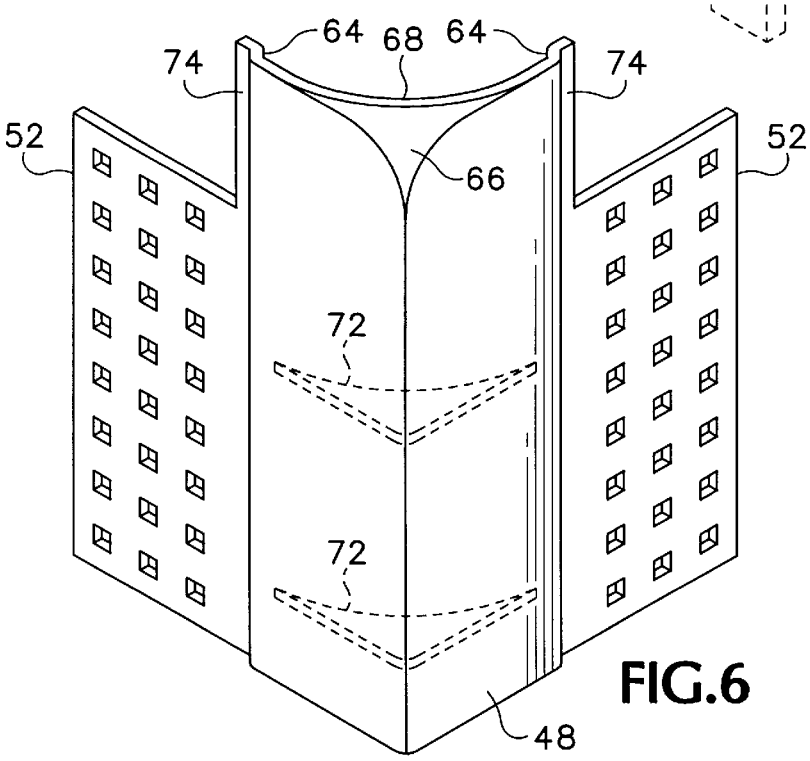

The flanges 52 of the trim piece shown in FIG. 6 are formed with three rows of holes 70. The tops of the flanges 52 are below the transition area 66. The trim piece has interior ribs 72 with concave surfaces matching the concave surface 68.

The trim piece shown in FIG. 6 is designed for installation using glue or nails. For installation using glue, glue is applied over the flange 28 of the corner bead and the trim piece is pressed into position with the bottom of the transition area 66 at the expected level of the upper edge of the base board, the concave surface 68 fitting snugly against the convexly curved portion of the corner bead, and the steps 64 between the flanges 52 and the intermediate portion 48 of the trim piece fitting in the steps 34 between the flanges 28 and the intermediate portion 26 of the corner bead. In this position, the flanges 52 fit against the flanges 28 of the corner bead and project slightly beyond the flanges 28 and the holes 70 of the outer row are just outside the flanges 28. Further, if the corner bead extends as far as the ribs 72, the concave surfaces of the inner ribs are seated firmly against the convexly curved portion of the corner bead. The glue penetrates the holes 70, so that when the glue is cured the trim piece is held firmly in position.

In the event that nails are used for installation, the trim piece is placed in the same position as for glue installation and nails are driven through the holes 70 of the outer row into the underlying drywall and lumber structure. Due to the positioning of the outer row of holes, it is not necessary to drive the nail through the steel corner bead. In fact, it is not even necessary to use nails that will penetrate the lumber structure, because shorter nails inserted through the holes of the outer row will be held in place by firm frictional engagement with the free edges of the flanges 28 of the corner bead.

It will be noted that the upper edges of the flanges 52 are below the transition area 66. Consequently, when the base board is installed, the flanges 52 are not visible. After the trim piece is installed, joint compound is applied in conventional fashion over the flanges of the corner bead and over the narrow lips 74 of the trim piece, forming upward extensions of the flanges 52, down at least to the bottom of the transition region 66.

U.S. Pat. No. Re. 34,547 discloses a trim piece for installation at a location at which three external right angle corners meet. The trim piece includes three limbs which are mutually perpendicular and meet at the point of the corner. Each limb has at its outer end a short flange or tongue that fits under the bullnose corner bead. This trim piece has some limitations in convenience because it necessitates that the ends of the corner bead be positioned with a precision that cannot easily be attained in the field. Further, it can be quite awkward and inconvenient to install the trim piece, because of the need to insert the tongues under all three strips of corner bead. Movement of the trim piece to insert one tongue will necessarily involve movement of the other tongues in a direction perpendicular to the direction required for inserting those tongues.

Figure 8:
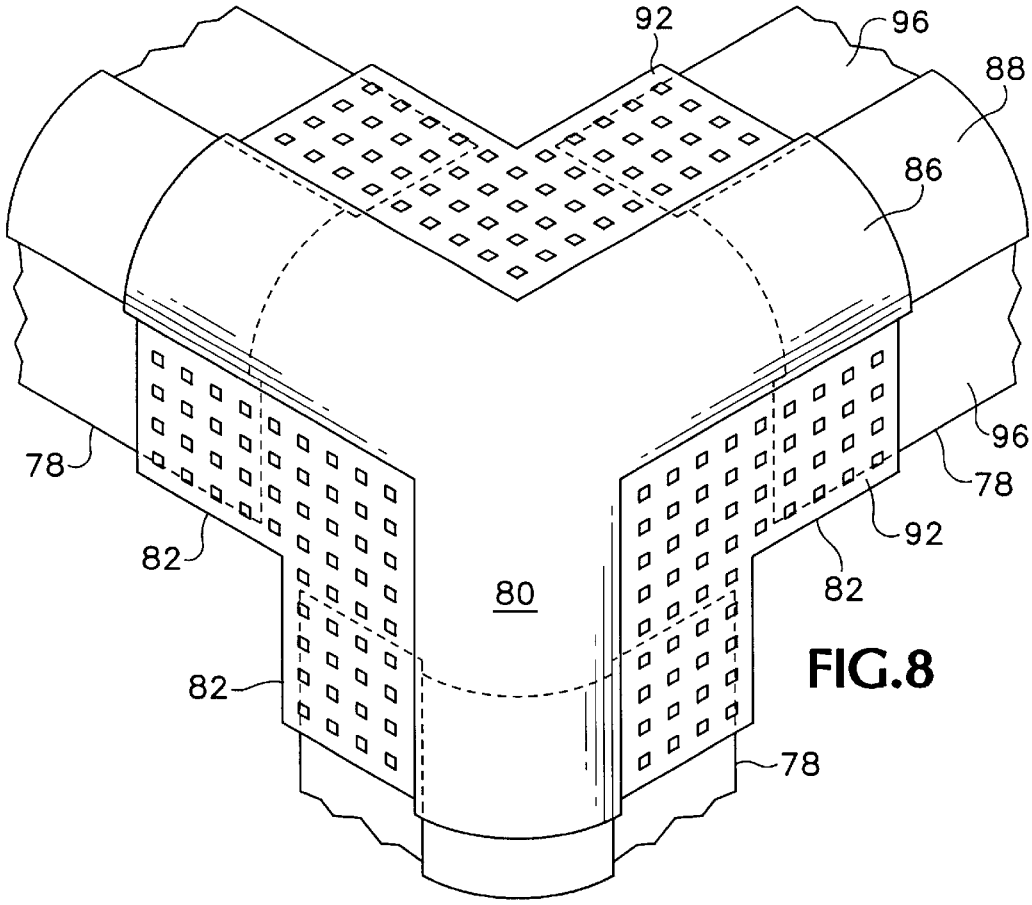
FIG. 8 is an exterior perspective view of a fourth trim piece in accordance with the invention.

FIG. 8 illustrates a trim piece suitable for installation at a three-way outside corner where three bullnose corner beads 78 meet. As shown in FIG. 8, the trim piece includes a three-sided corner piece or cap 80 which fits over the three-way corner of the drywall and lumber structure and three limbs 82 which project from the cap 80 and are mutually perpendicular. Each of the limbs 82 includes an intermediate portion 86, which fits over the intermediate portion 88 of one of the corner beads, and two flanges 92, which fit over the flanges 96 of the corner bead. The trim piece shown in FIG. 8 is designed for installation using glue. Glue is applied to the flanges of the corner bead and the trim piece is positioned as shown. Glue penetrates the holes in the flanges 92 and the trim piece is held firmly in position when the glue is cured.

Figure 7:
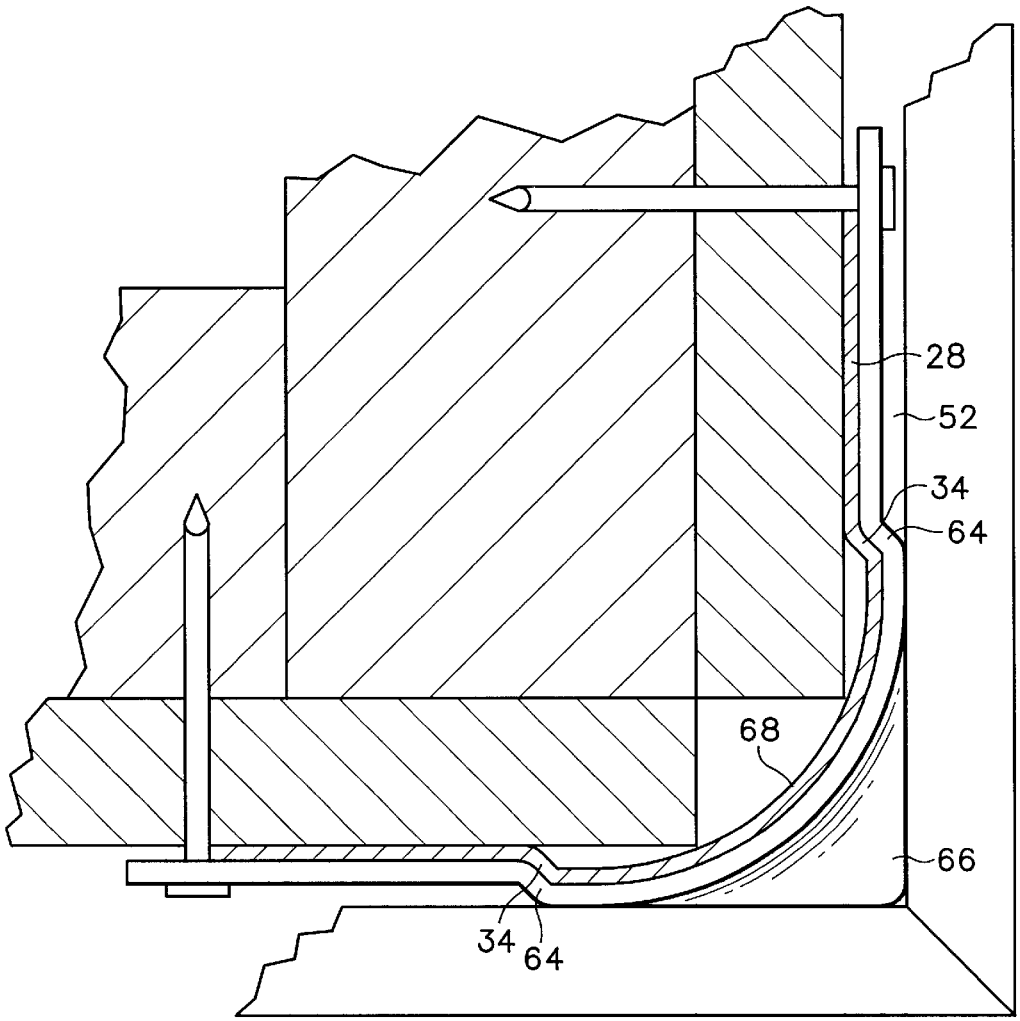
FIG. 7 is a horizontal sectional view of an external right angle corner provided with a bull nose corner bead and the third trim piece.

By suitably positioning the holes in the flanges 92, it would be possible to provide for installation using nails, as described with reference to FIGS. 6 and 7.

It will be appreciated that the invention is not restricted to the particular embodiments that have been described, and that variations may be made therein without departing from the scope of the invention as defined in the appended claims and equivalents thereof. For example, although the trim piece described with reference to the drawings is made of synthetic polymer material, it may be made of another suitable material such as sheet metal, which can readily be formed to the desired shape. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

What is claimed is:

1. A trim piece for installing at a drywall external right angle corner at which two drywall boards meet and which is provided with a bullnose corner bead having first and second flanges extending over the two drywall boards respectively and a convexly curved portion joining the first and second flanges, the first and second flanges having respective mutually parallel free edges, said trim piece comprising:

an intermediate portion which wraps over the convexly curved portion of the bullnose corner bead and has first and second edges extending parallel to the edges of the flanges of the corner bead and also has two opposite ends, first and second leaves attached to the intermediate portion of the trim piece at the first and second edges respectively, and first and second pins projecting from the first and second leaves respectively, the first and second pins being located so that when the trim piece is placed over the corner bead and the leaves are forced against the flanges of the corner bead, the pins are driven into the drywall boards and a flank of each pin bears firmly against a free edge of a flange of the corner bead, whereby the trim piece is held in position relative to the corner bead, and the intermediate portion of the trim piece including a transition region having a first end at one end of the intermediate portion and a second end spaced from the first end, the transition region having an interior surface at said first end matching closely the exterior surface of the corner bead at said first end and an exterior surface which is convexly curved at said first end and is right-angled at said second end and provides a transition from the convex curve to the right angle between said first and second ends.

2. A trim piece according to claim 1, comprising a first pair of pins projecting from the first leaf and a second pair of pins projecting from the second leaf; the first pair of pins being spaced apart parallel to the edges of the intermediate portion and the second pair of pins being spaced apart parallel to the edges of the intermediate portion.

3. A trim piece according to claim 1, including a gauge strip projecting from the intermediate portion at the end opposite said one end and extending parallel to the edges of the intermediate portion.

4. A trim piece according to claim 3, wherein the gauge strip includes graduations to facilitate severing the gauge strip at a desired location.

5. A trim piece according to claim 1, wherein the first leaf comprises a first flange attached to the intermediate portion at the first edge thereof and a first tab hingedly attached to the first flange, the second leaf comprises a second flange attached to the intermediate portion at the second edge thereof and a second tab hingedly attached to the second flange, and the first and second pins project from the first and second tabs respectively.

6. A trim piece for installing at a drywall external right angle corner at which two drywall boards meet and which is provided with a bullnose corner bead having first and second flanges extending over the two drywall boards respectively and a convexly curved portion joining the first and second flanges, the first and second flanges having respective mutually parallel free edges, said trim piece comprising:

an intermediate portion which wraps over the convexly curved portion of the bullnose corner bead and has first and second edges extending parallel to the edges of the flanges of the corner bead and also has two opposite ends, and first and second leaves attached to the intermediate portion of the trim piece at the first and second edges respectively, and the intermediate portion of the trim piece including a transition region having a first end at one end of the intermediate portion and a second end spaced from the first end, the transition region having an interior surface at said first end matching closely the exterior surface of the corner bead at said first end and an exterior surface which is convexly curved at said first end and is right-angled at said second end and provides a transition from the convex curve to the right angle between said first and second ends.

7. A trim piece according to claim 6, including a gauge strip projecting from the intermediate portion at the end opposite said one end and extending parallel to the edges of the intermediate portion.

8. A trim piece according to claim 7, wherein the gauge strip includes graduations to facilitate severing the gauge strip at a desired location.

9. A trim piece according to claim 1, wherein the first leaf comprises a first substantially rigid flange and the second leaf comprises a second substantially rigid flange, and the first and second pins project from the first and second flanges respectively.

10. A trim piece according to claim 6, wherein said intermediate portion includes at least one rib spaced from the first end of the transition region and projecting interiorly of the intermediate portion, said rib having an interior surface that matches closely the exterior surface of the corner bead.

11. A method of finishing a drywall external right angle corner defined by two drywall boards and provided with a bullnose corner bead mounted at the corner and having first and second flanges that extend over the two drywall boards respectively and have respective mutually parallel free edges, and a convexly curved portion joining the first and second flanges, said method comprising:

providing a trim piece comprising an intermediate portion having first and second parallel edges and two opposite ends, the intermediate portion including a transition region having a first end at one end of the intermediate portion and a second end spaced from the first end, and the transition region having an interior surface at said first end matching closely the exterior surface of the corner bead at said first end and an exterior surface which is convexly curved at said first end and is right-angled at said second end and provides a transition from the convex curve to the right angle between said first and second ends, and mounting the trim piece at a lower end of the corner with the intermediate portion of the trim piece wrapping over the convexly curved portion of the bullnose corner bead and the first and second edges of said intermediate portion extending parallel to the free edges of the flanges of the corner bead.

12. A method according to claim 11, further comprising installing first and second baseboard strips against the first and second drywall boards respectively, the baseboard strips meeting at said lower end of the corner and each having an upper edge substantially even in height with the second end of the transition region of the intermediate portion of the trim piece.

13. A method according to claim 11, wherein the trim piece also includes first and second leaves attached to the intermediate portion at the first and second edges respectively and the method comprises placing the trim piece over the corner bead and forcing the leaves against the flanges of the corner bead.

14. A method according to claim 11, wherein the trim piece includes first and second leaves attached to the intermediate portion at the first and second edges respectively and first and second pins projecting from the first and second leaves respectively, and the method comprises placing the trim piece over the corner bead and forcing the leaves against the flanges of the corner bead and thereby driving the pins into the drywall boards.

15. A method according to claim 11, wherein the trim piece includes first and second leaves attached to the intermediate portion at the first and second edges respectively and first and second pins projecting from the first and second leaves respectively, and the method comprises placing the trim piece over the corner bead and forcing the leaves against the flanges of the corner bead and thereby driving the pins into the drywall boards, and wherein the first and second pins are located so that when the leaves are forced against the flanges of the corner bead, a flank of each pin bears firmly against a free edge of a flange of the corner bead, whereby the trim piece is held in position relative to the corner bead.

* * * * *